US011718887B2

(12) United States Patent
Kong

(10) Patent No.: US 11,718,887 B2
(45) Date of Patent: Aug. 8, 2023

(54) FERRITE-BASED STAINLESS STEEL HAVING EXCELLENT IMPACT TOUGHNESS, AND METHOD FOR PRODUCING SAME

(71) Applicant: POSCO, Pohang-si (KR)

(72) Inventor: Jung Hyun Kong, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 236 days.

(21) Appl. No.: 16/765,300

(22) PCT Filed: Sep. 12, 2018

(86) PCT No.: PCT/KR2018/010694
§ 371 (c)(1),
(2) Date: May 19, 2020

(87) PCT Pub. No.: WO2019/117432
PCT Pub. Date: Jun. 20, 2019

(65) Prior Publication Data

US 2020/0283870 A1 Sep. 10, 2020

(30) Foreign Application Priority Data

Dec. 14, 2017 (KR) ..... 10-2017-0172355

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
CPC ..... C21D 9/46; C21D 6/005; C21D 6/008; C21D 8/0205; C21D 8/0226;
(Continued)

(56) References Cited

U.S. PATENT DOCUMENTS

2004/0055674 A1* 3/2004 Yazawa ..... C21D 8/0405 148/610
2018/0363089 A1* 12/2018 Yakushijin ..... C21D 6/008

FOREIGN PATENT DOCUMENTS

EP 3124635 A1 2/2017
EP 3239335 A1 11/2017
(Continued)

OTHER PUBLICATIONS

Office Action issued in corresponding Korean Patent Application No. 10-2017-0172355 dated Feb. 18, 2019, with English translation.
(Continued)

*Primary Examiner* — Nicholas A Wang
*Assistant Examiner* — Maxwell Xavier Duffy
(74) *Attorney, Agent, or Firm* — Morgan, Lewis & Bockius LLP

(57) ABSTRACT

Disclosed is a ferritic stainless hot-rolled annealed steel sheet with excellent impact properties of 6 mm or more in thickness and a manufacturing method thereof. A ferritic stainless steel with excellent impact toughness according to an embodiment of the present disclosure includes, in percent (%) by weight of the entire composition, C: more than 0 and 0.01% or less, Si: 0.8% or less, Mn: 0.5% or less, Cr: 10 to
(Continued)

14%, Ti: 0.01 to 0.45%, N: more than 0 and 0.015% or less, the remainder of iron (Fe) and other inevitable impurities, and an average misorientation between grains of microstructure is 0.6 to 1.1°.

4 Claims, 6 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/50*** | (2006.01) |

(52) U.S. Cl.
CPC ..... *C21D 8/0205* (2013.01); *C21D 8/0226* (2013.01); *C21D 8/0263* (2013.01); *C22C 38/001* (2013.01); *C22C 38/02* (2013.01); *C22C 38/04* (2013.01); *C22C 38/06* (2013.01); *C22C 38/42* (2013.01); *C22C 38/50* (2013.01); *C21D 2211/005* (2013.01)

(58) Field of Classification Search
CPC ..... C21D 8/0263; C21D 2211/005; C22C 38/001; C22C 38/02; C22C 38/04; C22C 38/06; C22C 38/42; C22C 38/50
See application file for complete search history.

(56) References Cited

FOREIGN PATENT DOCUMENTS

| | | | | |
|---|---|---|---|---|
| JP | H08-296000 | A | 11/1996 | |
| JP | H10-60543 | A | 3/1998 | |
| JP | 2011-214063 | A | 10/2011 | |
| JP | 2012-140687 | A | 7/2012 | |
| JP | 6022097 | B1 | 11/2016 | |
| JP | 2017-179436 | A | 10/2017 | |
| KR | 10-2014-0080350 | A | 6/2014 | |
| KR | 10-2016-0123371 | A | 10/2016 | |
| WO | WO-9703216 | A1 * | 1/1997 | ..... C21D 8/0205 |
| WO | WO-2017135240 | A1 * | 8/2017 | ..... B21B 3/02 |
| WO | 2017/163636 | A1 | 9/2017 | |
| WO | 2017/169011 | A1 | 10/2017 | |
| WO | 2017/199482 | A1 | 11/2017 | |

OTHER PUBLICATIONS

Chinese Office Action dated May 19, 2021 issued in Chinese Patent Application No. 201880080609.0 (with English translation).
Written Opinion and International Search Report dated Jan. 15, 2018 issued in International Patent Application No. PCT/KR2018/010694 (English translation).
Extended European Search Report dated Jun. 24, 2020 issued in European Patent Application No. 18889514.8.
Chinese Office Action dated Apr. 14, 2022 issued in Chinese Patent Application No. 201880080609.0 (with English translation).

* cited by examiner

【FIGURE 1】
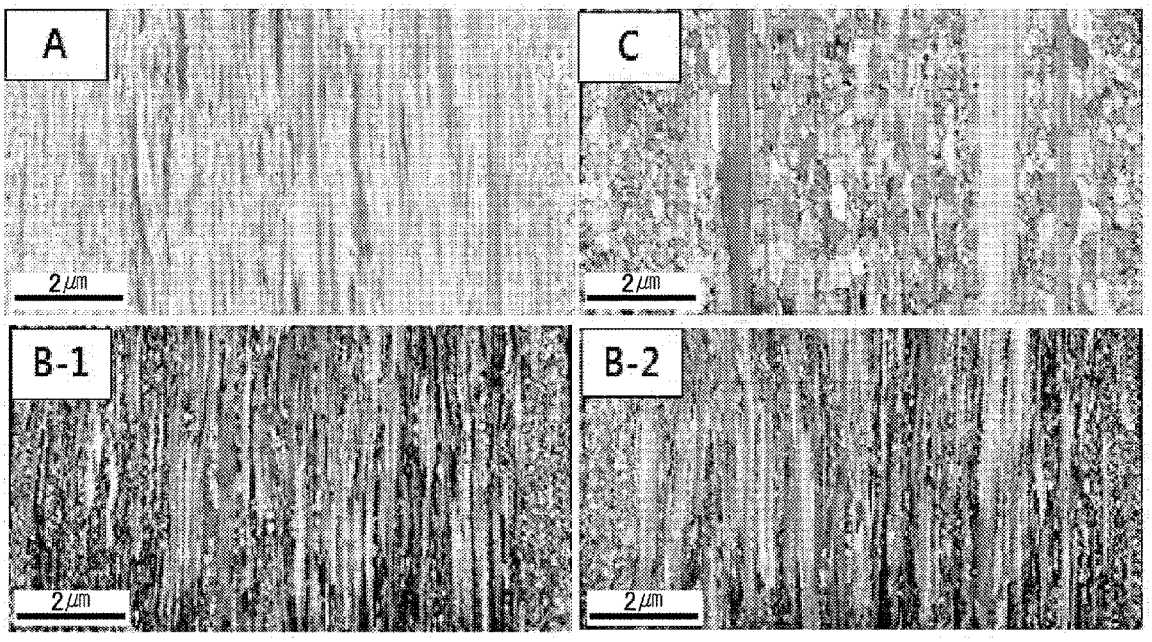

【FIGURE 2】
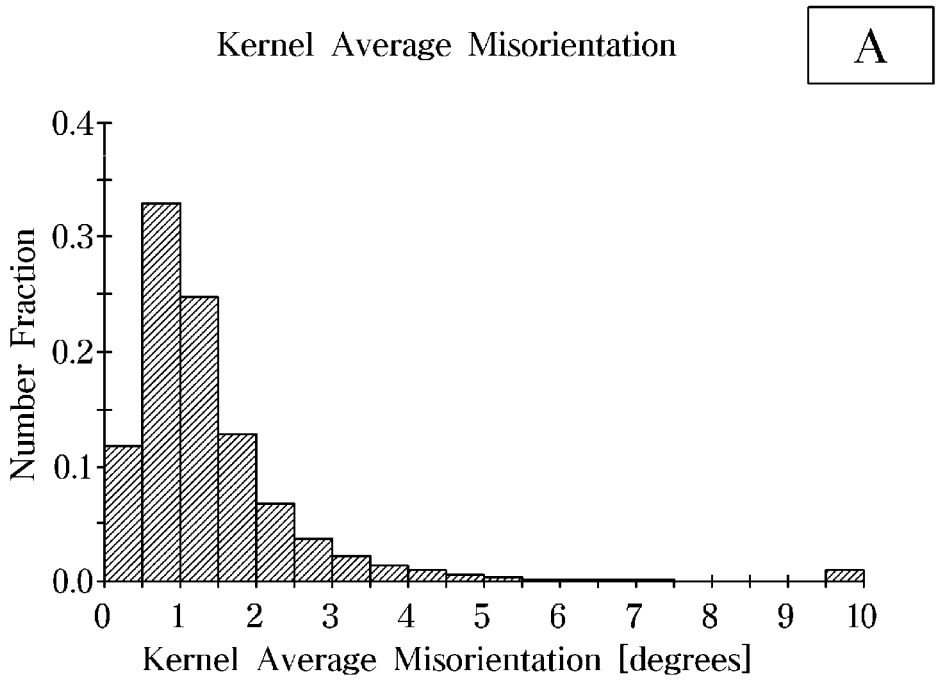

【FIGURE 3】
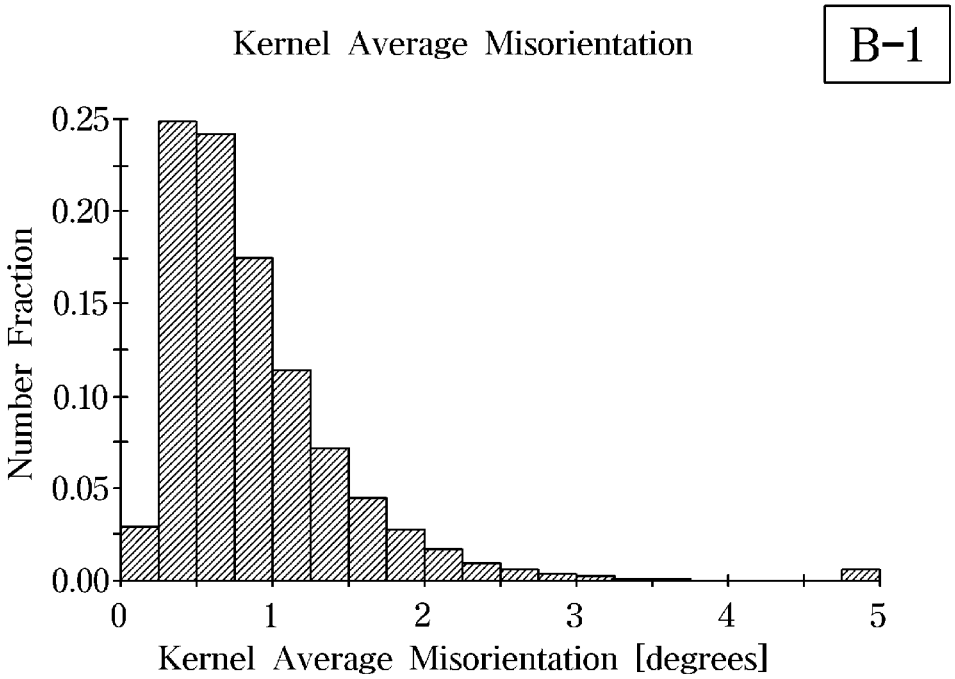

【FIGURE 4】
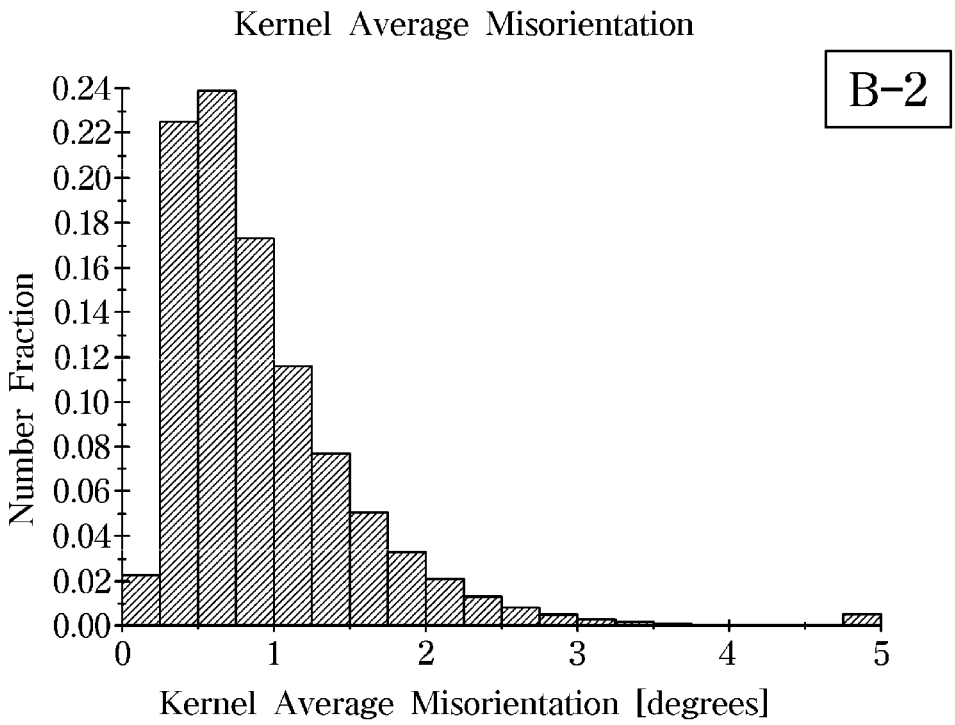

【FIGURE 5】
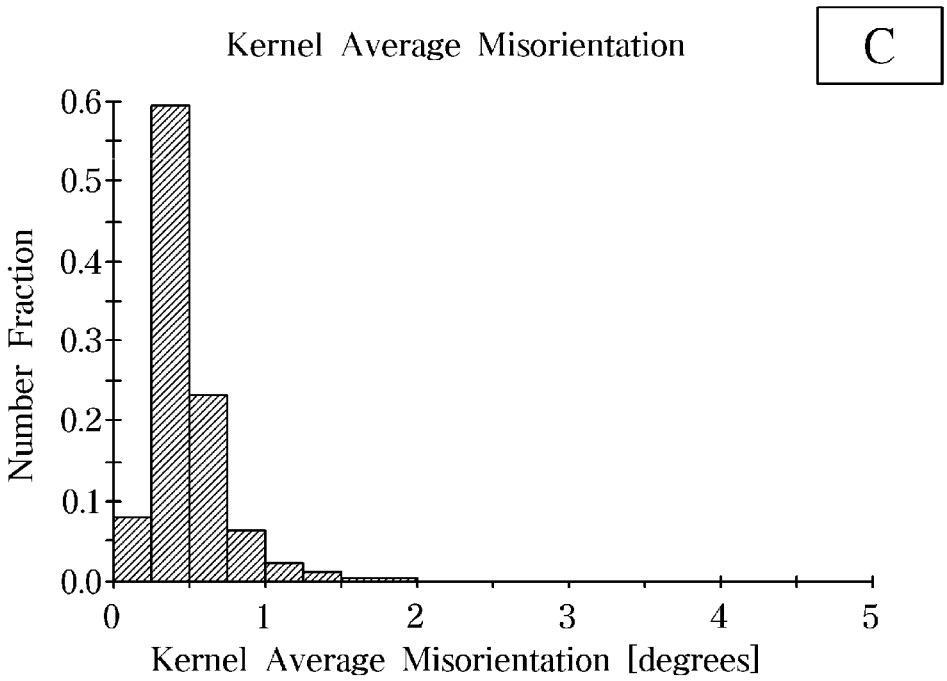

【FIGURE 6】
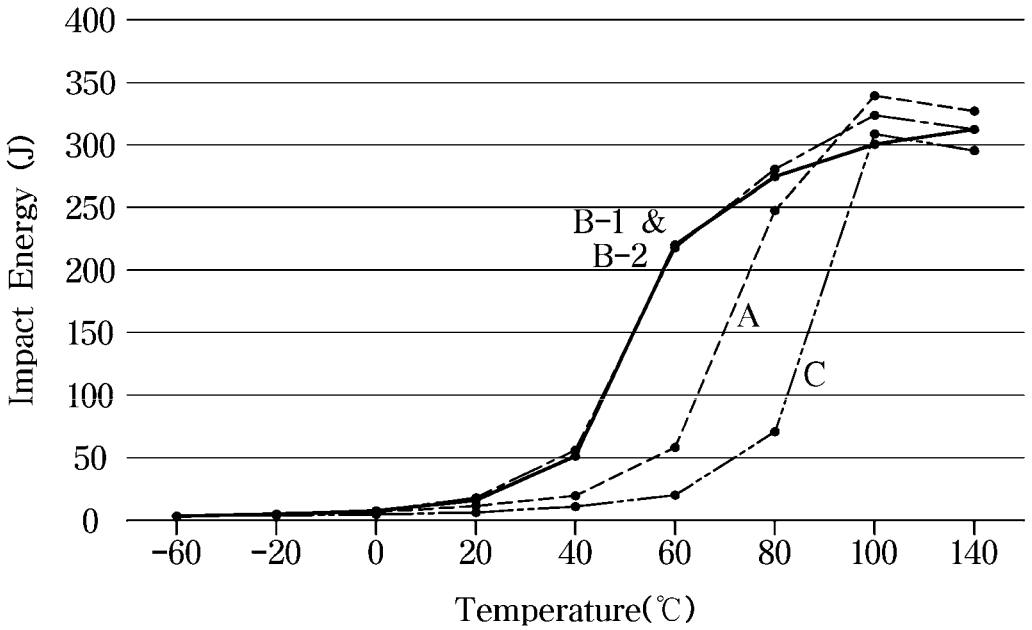

FERRITE-BASED STAINLESS STEEL HAVING EXCELLENT IMPACT TOUGHNESS, AND METHOD FOR PRODUCING SAME

CROSS-REFERENCE OF RELATED APPLICATIONS

This application is the U.S. National Phase under 35 U.S.C. § 371 of International Patent Application No. PCT/KR2018/010694, filed on Sep. 12, 2018, which in turn claims the benefit of Korean Application No. 10-2017-0172355, filed on Dec. 14, 2017, the entire disclosures of which applications are incorporated by reference herein.

TECHNICAL FIELD

The present disclosure relates to a ferritic stainless steel with excellent impact toughness and a manufacturing method thereof, and more particularly, to a ferritic stainless hot-rolled annealed steel sheet containing Ti and having excellent impact property of 6 mm or more in thickness and a manufacturing method thereof.

BACKGROUND ART

Ferritic stainless steel has inferior workability, impact toughness and high temperature strength compared to austenitic stainless steel, but since it does not contain a large amount of Ni, it is inexpensive and has low thermal expansion. In recent years, it is preferred to use it for automobile exhaust system component materials. In particular, flanges for exhaust systems have recently been converted into ferritic stainless thick plates with improved corrosion resistance and durability due to micro-cracks and exhaust gas leakage problems.

STS409L material is a steel grade to prevent sensitization of welds by stabilizing C and N with Ti at 11% Cr, has excellent workability and mainly used at temperatures below 700° C. STS409L material is the most widely used steel grade because it has some corrosion resistance even to the condensate component generated in the automobile exhaust system.

However, as the thickness of ferritic stainless steel is thicker than that of austenitic stainless steel, workability and impact toughness are inferior. Therefore, ferritic stainless steel has a brittle crack or crack propagation during cold rolling to a target thickness after hot rolling, thereby causing fracture of the plate. When processing products such as flanges using STS409L thick plates with a thickness of 6.0 mm or more, there is a disadvantage in that impact properties are inferior, such as cracks generated by impacts. Due to this low impact property, STS409L steel with a thickness of 6.0 mm or more is a very difficult steel to manufacture and process.

In addition, during hot rolling, it is difficult to obtain fine grains due to a lack of rolling reduction, and brittleness is further increased by formation of coarse grains and non-uniform grains, and the impact property is deteriorated.

DISCLOSURE

Technical Problem

The embodiments of the present disclosure solve the above problems, and thus provide a ferritic stainless steel with improved impact toughness and a manufacturing method thereof by securing a recovery structure rather than a completely recrystallized structure by controlling the annealing temperature of ferritic stainless hot-rolled thick plate with a thickness of 6.0 mm or more.

Technical Solution

In accordance with an aspect of the present disclosure, a ferritic stainless steel with excellent impact toughness includes, in percent (%) by weight of the entire composition, C: more than 0 and 0.01% or less, Si: 0.8% or less, Mn: 0.5% or less, Cr: 10 to 14%, Ti: 0.01 to 0.45%, N: more than 0 and 0.015% or less, the remainder of iron (Fe) and other inevitable impurities, and an average misorientation between grains of microstructure is 0.6 to 1.1°.

The stainless steel may have a thickness of 6.0 to 25.0 mm.

The ferritic stainless steel may further include Ni: 0.3% or less, Cu: 0.5% or less, Al: 0.1% or less.

The stainless steel may satisfy a following equation (1)

$$Ti/(C+N) \geq 3 \quad (1)$$

Ti, C, N mean the content (% by weight) of each element.

The stainless steel may have a yield strength of 305 MPa or more, a tensile strength of 420 MPa or more, an elongation of 35 to 40%, and satisfies the following equation (2).

$$20° \text{ C. charpy impact energy} \times 40° \text{ C. charpy impact energy} \geq 750 \text{ J/cm}^2 \quad (2)$$

In accordance with another aspect of the present disclosure, a manufacturing method of a ferritic stainless steel with excellent impact toughness, the manufacturing method includes: heating a slab comprising, in percent (%) by weight of the entire composition, C: more than 0 and 0.01% or less, Si: 0.8% or less, Mn: 0.5% or less, Cr: 10 to 14%, Ti: 0.01 to 0.45%, N: more than 0 and 0.015% or less, the remainder of iron (Fe) and other inevitable impurities to 1,220° C. or less; rough rolling the heated slab; finishing rolling the rough rolled bar; and annealing the hot rolled steel sheet, and a sum of reduction ratio at the rear end of the rough rolling is 54% or more, and a thickness of the hot rolled steel sheet is 6.0 to 25.0 mm.

The slab may further include Ni: 0.3% or less, Cu: 0.5% or less, Al: 0.1% or less and satisfies a following equation (1)

$$Ti/(C+N) \geq 3 \quad (1)$$

Ti, C, N mean the content (% by weight) of each element.

The temperature of the rough rolled bar may be 1,020 to 970° C.

The finishing rolling end temperature may be 960° C. or less.

The hot rolling annealing may be performed at 850 to 980° C., and an average misorientation between grains of microstructure of the hot-rolled annealed steel sheet may be 0.6 to 1.1°.

Advantageous Effects

According to an embodiment of the present disclosure, by controlling the microstructure of the ferritic stainless hot-rolled thick plate with a thickness of 6.0 mm or more to a recovery tissue, a high charpy impact energy value can be exhibited.

In addition, it is possible to provide ferritic stainless steel having excellent impact toughness and yield strength of 305 MPa or more and tensile strength of 440 MPa or more.

DESCRIPTION OF DRAWINGS

FIG. 1 is a photograph showing the microstructure of a hot-rolled annealed steel sheet according to the annealing temperature of the embodiment of the present disclosure.

FIGS. 2 to 5 are graphs showing an average misorientation between grains of a hot-rolled annealed steel sheet according to an annealing temperature of the embodiment of the present disclosure analyzed according to the Kernel Average Misorientation method.

FIG. 6 is a graph showing the charpy impact energy value for each temperature according to the annealing temperature of the embodiment of the present disclosure.

BEST MODE

A ferritic stainless steel with excellent impact toughness according to an embodiment of the present disclosure includes, in percent (%) by weight of the entire composition, C: more than 0 and 0.01% or less, Si: 0.8% or less, Mn: 0.5% or less, Cr: 10 to 14%, Ti: 0.01 to 0.45%, N: more than 0 and 0.015% or less, the remainder of iron (Fe) and other inevitable impurities. Hereinafter, embodiments of the present disclosure will be described in detail with reference to the accompanying drawings.

MODES OF THE INVENTION

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

Also, when a part "includes" or "comprises" an element, unless there is a particular description contrary thereto, the part may further include other elements, not excluding the other elements.

An expression used in the singular encompasses the expression of the plural, unless it has a clearly different meaning in the context.

Various methods have been studied for improving the toughness of ferritic stainless hot rolled thick plates. First, there is a method of suppressing the Laves Phase, which deteriorates the brittleness of a material by lowering the hot-rolled coiling temperature or by performing a rapid cooling treatment such as water cooling. However, this method is difficult to apply to actual production, or causes bad coils such as scratch marks on the surface of the plate due to low temperature when coiling, or has a problem in that the deformation of the plate becomes non-uniform due to the rapid cooling rate, and partially cracks are generated. Therefore, this method has difficulties in practical production applications. Also, when hot rolling of ferritic stainless steel having a thickness of 6.0 mm or more, it is difficult to obtain a fine grain size due to insufficient rolling reduction compared to a steel plate with a thickness of 6.0 mm or less, and a problem of increasing brittleness due to formation of coarse grains and non-uniform grains has also been raised.

The present disclosure secures a microstructure in a recovery step, not a completely recrystallized microstructure by controlling the hot rolling and hot rolling annealing process of hot rolled thick plate having a thickness of 6.0 mm or more, rearranges the dislocations arranged in disorder in the recovered grain boundaries through annealing at a specific temperature and improves the impact toughness of the Ti-containing ferritic stainless hot-rolled thick plate by suppressing the propagation of impact through the rearranged dislocations.

In this specification, 'ferritic stainless steel' means a hot-rolled annealed steel sheet with a thickness of 6.0 mm or more.

A ferritic stainless steel with excellent impact toughness according to an embodiment of present disclosure includes, in percent (%) by weight of the entire composition, C: more than 0 and 0.01% or less, Si: 0.8% or less, Mn: 0.5% or less, Cr: 10 to 14%, Ti: 0.01 to 0.45%, N: more than 0 and 0.015% or less, the remainder of iron (Fe) and other inevitable impurities, has an average misorientation between grains of microstructure of 0.6 to 1.1° and has a thickness of 6.0 to 25.0 mm.

In the present disclosure, the target steel grade to improve impact toughness is a ferritic stainless thick plate containing Cr: 10 to 14 wt % and Ti: 0.01 to 0.45 wt %, for example, STS409L steel grade.

Hereinafter, the reason for the numerical limitation of the alloy component element content in the embodiment of the present disclosure will be described. In the following, unless otherwise specified, the unit is % by weight.

The content of C and N is more than 0 and less than 0.01%.

In the case of C and N being present in an interstitial form as Ti(C, N) carbonitride-forming elements, Ti(C, N) carbonitride is not formed when C and N contents are high, and C and N present at a high concentration deteriorate elongation and low-temperature impact properties of the material. When the material is used at 600° C. or below for a long period of time after welding, intergranular corrosion occurs due to generation of $Cr_{23}C_6$ carbide, and therefore the content of C and N is preferably controlled to be 0.01% or less, respectively.

The content of Si is 0.8% or less.

Si is an element added as a deoxidizing element, and when its content is increased as a ferrite-phase forming element, ferrite-phase stability is increased. If the content of Si is more than 0.8%, steelmaking Si inclusions are increased and surface defects occur. For this reason, the Si content is preferably controlled to be 0.8% or less.

The content of Mn is 0.5% or less.

When the Mn content is increased, pitting corrosion resistance is decreased by the formation of a precipitate such as MnS. Therefore, the Mn content is preferably controlled to be 0.5% or less.

The content of Cr is 10 to 14%.

Cr is an essential element for ensuring corrosion resistance of stainless steel. When the content of Cr is low, corrosion resistance is lowered in an atmosphere of condensed water, and when the content is high, strength is increased and elongation and impact characteristics are lowered. In the present disclosure, since the target steel type to improve impact toughness is a ferritic stainless steel thick plate containing 10 to 14% Cr, the content of Cr is limited to 10 to 14%.

The content of Ti is 0.01 to 0.45%.

Ti is an effective element that fixes C and N to prevent intergranular corrosion. However, when the content of Ti is decreased, due to intergranular corrosion occurring at welded areas, corrosion resistance is decreased, and therefore Ti is preferably controlled to be at least 0.01% or more. However, when the Ti content is too high, steelmaking inclusions are increased, a number of surface defects such as scabs may occur due to an increase in steelmaking inclusions, a nozzle blocking phenomenon occurs in a continuous casting process. For this reason, the Ti content is controlled to be 0.45% or less and more preferably 0.35% or less.

In addition, according to an embodiment of the present disclosure, the following equation (1) may be satisfied.

$$Ti/(C+N) \geq 3 \quad (1)$$

In the Ti-added ferritic stainless steel, as the content of C+N increases, the content of C and N employed in the base material increases, which further induces brittleness of the material. Therefore, The ratio of Ti/(C+N) is controlled to be at least 3 or higher.

In addition, the ferritic stainless steel with excellent impact toughness according to an embodiment of the present disclosure may further include Ni: 0.3% or less, Cu: 0.5% or less, Al: 0.1% or less.

The content of Ni is 0.3% or less.

Ni is an effective element for suppressing the evolution of the pitting, and it is also effective in improving the toughness of the hot rolled steel sheet when a small amount of 0.01% or more is added. However, the addition of a large amount may cause material hardening and toughness deterioration due to solid solution strengthening, and there is a problem that the alloy cost increases. Therefore, it is preferable to limit it to 0.3% or less.

The content of Cu is 0.5% or less.

Cu serves to improve corrosion resistance when a certain amount is added, but it is preferable to limit it to 0.5% or less since excessive addition generates Cu precipitates and decreases toughness.

The content of Al is 0.1% or less.

Al is useful as a deoxidizing element and its effect can be expressed at 0.005% or more. However, the excessive addition causes the lowering of ductility and toughness at room temperature, so the upper limit is set to 0.1% and need not be contained.

In the present disclosure, the thickness of ferritic stainless steel to improve impact toughness is 6.0 to 25.0 mm.

As described above, in the hot-rolled annealing thick plate, there is a brittleness problem due to insufficient rolling reduction, and the thickness of the ferritic stainless steel according to the present disclosure for solving this is 6.0 mm or more. However, the upper limit may be 25.0 mm in consideration of the thickness of the rough-rolled bar after rough-rolling. Preferably, it may be 12.0 mm or less to be suitable for manufacturing use.

The microstructure of ferritic stainless steel with excellent impact toughness according to an embodiment of the present disclosure may be a recovery structure having an average misorientation between grains of 0.6 to 1.1°.

The inventors of the present disclosure have found that some recrystallized recovery structures exhibit superior impact properties compared to non-annealed or fully recrystallized structures. The recovery structures may be difficult to distinguish from non-annealed and fully recrystallized structures, but can be distinguished through misorientation between grains between grain boundaries in the grain boundary structure. In general, it is known that the average misorientation between grains of a deformed specimen increases because the distortion of crystal orientation increases as the amount of deformation increases.

The average misorientation between grains of the non-annealed structure is 1.2° or more, and the average misorientation between grains of the fully recrystallized structure is 0.5° or less. That is, the average misorientation between grains gradually decreases from a non-annealed structure to a fully recrystallized structure, which means that recrystallization is performed by arranging in a direction in which grain-boundary energy decreases.

The non-annealed structure has high strength and low elongation due to the stress remaining inside, and the impact property is inferior, and the fully recrystallized structure has low strength due to stress removal and cannot suppress the propagation of impact due to dissipation of dislocation. The ferritic stainless steel according to the present disclosure can improve the impact toughness by suppressing the propagation of the impact by relocating the dislocation generated through the low temperature hot rolling process, which will be described later, to the recovered grain boundaries.

Accordingly, the ferritic stainless steel with excellent impact toughness of the present disclosure can satisfy the following equation (2).

$$20^\circ \text{ C. charpy impact energy} \times 40^\circ \text{ C. charpy impact energy} \geq 750 \text{ J/cm}^2 \quad (2)$$

For example, 20° C. charpy impact energy of ferritic stainless steel according to the present disclosure may represent 15 J/cm$^2$ or more, and 40° C. charpy impact energy may represent 50 J/cm$^2$ or more.

Next, a manufacturing method of a ferritic stainless steel with excellent impact toughness according to an embodiment of the present disclosure will be described.

The manufacturing method of a ferritic stainless steel with excellent impact toughness according to an embodiment of the present disclosure includes a heating a slab including, in percent (%) by weight of the entire composition, C: more than 0 and 0.01% or less, Si: 0.8% or less, Mn: 0.5% or less, Cr: 10 to 14%, Ti: 0.01 to 0.45%, N: more than 0 and 0.015% or less, the remainder of iron (Fe) and other inevitable impurities to 1,220° C. or less; a rough rolling the heated slab; a finishing rolling the rough rolled bar; and an annealing the hot rolled steel sheet, and a sum of reduction ratio at the rear end of the rough rolling is 54% or more, and a thickness of the hot rolled steel sheet is 6.0 to 25.0 mm.

The reason for the numerical limitation of the alloy element content and the thickness of the hot rolled steel sheet are as described above.

After heating the slab containing the alloy element of the above composition to 1,220° C. or less prior to hot rolling, the heated slab can be rough rolled. At this time, it is possible to control the sum of the reduction ratio at the rear end of the rough rolling to 54% or more.

In general, when the thickness of the hot-rolled steel sheet is thick, the reduction ratio is lowered, so that the amount of dislocation is reduced as the stress applied to the material is low. Therefore, as the thickness of the hot rolled steel sheet becomes thicker, the heating furnace temperature before hot rolling is made as low as possible, and when hot rolling, the load distribution of the rough rolling is moved to the rear end to perform a strong reduction at the rear end having a lower temperature than the front end.

The slab heating temperature is preferably 1,220° C. or less for dislocation generation through low temperature hot rolling, and when the slab temperature is too low, rough rolling is impossible, so the lower limit of the heating temperature may be 1,150° C. or higher.

Since rough rolling typically consists of 3 to 4 rolling mills, the rough rolling rear end in the present disclosure may mean the last rolling mill and the second rolling mill at the end. Even in the rough rolling step consisting of five or more rolling mills, it may mean the last rolling mill and the second rolling mill at the end. For example, the reduction ratio of the two rear-end rolling mills may be 27% or more, respectively. It is possible to smoothly generate dislocation of the hot rolled steel sheet by strongly reducing so that the sum of the reduction ratio at the rear end of the rough rolling is 54% or more.

The rough-rolled bar manufactured through the rough-rolling process may be finished rolled to a thickness of 6.0 to 25.0 mm, and then heat-annealed.

After the rough rolling, the rough rolling bar before the finish rolling may have a temperature of 1,020 to 970° C., and the end temperature of the finish rolling may be 960° C. or less. More preferably, the finish rolling end temperature may be 920° C. or less. A large amount of dislocation can be generated by performing a low temperature hot rolling process by controlling the slab heated to 1,220° C. or less to the above temperature range.

Subsequently, the hot-rolled steel sheet may be annealed at 850 to 980° C. When the annealing temperature is less than 850° C., the annealing time for dislocation relocation takes a long time to decrease productivity, and when it exceeds 980° C., recrystallization may be performed beyond relocation of the dislocation.

By relocating the dislocation generated during the hot rolling through annealing heat treatment, dislocations regularly rearranged can suppress propagation of cracks caused by impact. However, when the re-heating temperature and the finish rolling temperature are too low outside the above-mentioned hot rolling temperature range schedule, during hot rolling, the frictional pressure between the material and the rolling roll is high, so that the surface of the material may be torn or scratched by the rolling roll. Therefore, in order to form the recovery structure, the hot rolled steel sheet is manufactured according to the load distribution at the rear end of the rough rolling and the temperature range of the low temperature hot rolling process, and hot rolling annealing heat treatment in the range of 850 to 980° C. should be performed.

The ferritic stainless hot-rolled annealed steel sheet subjected to the low-temperature hot-rolling process and hot-rolled annealing heat treatment may have a recovery structure with an average misorientation between grains of microstructure of 0.6 to 1.1°.

Hereinafter, a preferred embodiment of the present disclosure will be described in more detail.

EXAMPLE

The slab of the composition shown in Table 1 was heated to 1,200° C., and then hot rolled to a thickness of 10.0 mm so that the finish rolling end temperature was 940° C. by setting the sum of the reduction ratios at the rear of the rough rolling to 55%. At this time, the mass-flow temperature of the rough rolling bar before finishing rolling was set to about 1,000° C.

Non-annealing (A), 930° C. hot-rolled annealing (B: B-1, B-2), and 1,020° C. hot-rolled annealing (C) were performed on 10.0 mm thick hot rolled steel sheets, respectively, to prepare 11Cr-0.2Ti ferritic stainless steel sheets. The 930° C. hot-rolled annealed steel sheet, which is an example range of the present disclosure, was produced in two types, B-1 and B-2, to confirm reproducibility.

Hot-Rolled Annealing (B: B-1, B-2), 1,020° C. Hot Rolled Annealing (C) 11Cr-0.2Ti ferritic stainless steel. Two kinds of steel sheets B-1 and B-2 annealed at 930° C. hot rolling are prepared.

TABLE 1

| composition (wt %) | | | | | | | |
|---|---|---|---|---|---|---|---|
| C | Si | Mn | Cr | Ti | Al | Cu | N |
| 0.0045 | 0.55 | 0.3 | 11.2 | 0.23 | 0.03 | 0.01 | 0.0055 |

1. Microstructure

FIG. 1 is a photograph showing the microstructure of a hot-rolled annealed steel sheet according to the annealing temperature of the embodiment of the present disclosure.

FIG. 1 shows microstructures of hot-rolled annealed steel sheets prepared by non-annealing (A), hot rolling annealing at 930° C. (B: B-1, B-2), and hot rolling annealing (C) at 1,020° C., respectively. A is a non-annealed hot rolled black coil, which represents the structure after typical hot rolling. And C is mostly recrystallized by hot-annealing at 1,020° C. However, since the hot rolling reduction ratio is low, some unrecrystallized band structure was observed. As shown in B-1 and B-2, the microstructure annealed at 930° C., which is the hot rolled annealing temperature range of the present disclosure, is a structure of an unrecrystallized recovery step, and some fine grains are observed.

Subsequently, the average misorientation between grains of each microstructure according to the annealing temperature was calculated according to the Kernel Average Misorientation method and is shown in Table 2 below. The Kernel Average Misorientation method is a technique capable of analyzing average misorientation between grains according to the average amount of deformation of a material through Electron Back Scattered Diffracrion (EBSD).

TABLE 2

| average misorientation between grains(°) | | | |
|---|---|---|---|
| Comparative Example 1 | Inventive Example | | Comparative Example 2 |
| A | B-1 | B-2 | C |
| 1.44 | 0.86 | 0.88 | 0.41 |

FIGS. 2 to 5 are graphs showing an average misorientation between grains of a hot-rolled annealed steel sheet according to an annealing temperature of the embodiment of the present disclosure analyzed according to the Kernel Average Misorientation method.

As shown in FIGS. 2 to 5 and Table 2, the average misorientation between grains of Comparative Example 1 (A) showing a non-annealed hot rolled black coil was the highest with 1.44° and the average misorientation between grains of completely recrystallized Comparative Example 2 (C) was about 0.4°, showing the smallest misorientation. In addition, the average misorientation of the B-1 and B-2 recovery structures corresponding to the present disclosure example was about 0.87°, indicating a moderate level of average misorientation between the non-annealed hot-rolled black coil A and completely recrystallized C.

2. Impact Toughness Evaluation

The non-annealed material (A), 930° C. hot-rolled annealing material (B: B-1, B-2), and 1,020° C. hot-rolled annealing material (C) were subjected to Charpy impact tests at each temperature according to ASTM E 23 standards, and the results are shown in Table 3 below

TABLE 3

| temperature | charpy impact energy (J/cm$^2$) | | | |
|---|---|---|---|---|
| | Comparative Example 1 | Inventive Example | | Comparative Example 2 |
| (° C.) | A | B-1 | B-2 | C |
| −60 | 3.06 | 3.41 | 3.3 | 3.3 |
| −20 | 4.14 | 4.37 | 4.73 | 3.89 |
| 0 | 6.54 | 7.15 | 7.63 | 4.98 |
| 20 | 11.33 | 17.03 | 16.23 | 6.3 |
| 40 | 19.88 | 55.66 | 51.29 | 10.95 |
| 60 | 58.44 | 218.48 | 220.21 | 20.44 |
| 80 | 247.53 | 280.36 | 274.56 | 70.98 |
| 100 | 338.81 | 323.37 | 300.38 | 308.75 |
| 140 | 326.58 | 312.35 | 312.35 | 295.38 |

It can be seen that the present disclosure examples B-1 and B-2 show higher charpy impact energy values when compared with Comparative Example 1 (A) and Comparative Example 2 (C). In particular, it was confirmed that the charpy impact energy values of Inventive Examples (B-1, B-2) were significantly higher from room temperature 20° C. and 40° C.

FIG. 6 is a graph showing the charpy impact energy value for each temperature according to the annealing temperature of the embodiment of the present disclosure.

Referring to FIG. 6 and Table 3, compared to Comparative Example 1 (A) and Comparative Example 2 (C), it can be seen that the charpy impact energy values of Inventive Examples (B-1, B-2) were shifted to the left by showing high values even at low temperatures. That is, it shows improved impact toughness in the microstructure of the recovery stage than the recrystallized microstructure at the same thickness of 10.0 mm. It was confirmed that the dislocations regularly rearranged due to the rearrangement of dislocations generated during hot rolling suppress crack propagation caused by impact.

3. Tensile Test Evaluation

The above-mentioned non-annealed material (A), 930° C. hot-rolled annealing material (B: B-1, B-2), and 1,020° C. hot-rolled annealing material (C) were evaluated by tensile test, and the test results are shown in Table 4 below.

TABLE 4

| | Comparative Example 1 | Inventive Example | | Comparative Example 2 |
|---|---|---|---|---|
| | A | B-1 | B-2 | C |
| Yield Strength (MPa) | 347.1 | 309.2 | 307.8 | 300.6 |
| Tensile Strength (MPa) | 464.7 | 446.1 | 444.8 | 414.5 |
| Elongation (%) | 33.1 | 37.2 | 36.5 | 41.1 |

Referring to Table 4, the yield strength and tensile strength of the present disclosure examples (B-1, B-2) indicate lower yield strength and tensile strength values as stress is relaxed compared to Comparative Example 1 (A), and the elongation shows an improved value of about 3 to 4%. On the other hand, Comparative Example 2 (C) shows lower yield strength and tensile strength values due to dislocation disappearance generated during hot rolling and stress elimination, and elongation also shows a high value of 41%.

While the present disclosure has been particularly described with reference to exemplary embodiments, it should be understood by those of skilled in the art that various changes in form and details may be made without departing from the spirit and scope of the present disclosure.

INDUSTRIAL APPLICABILITY

The ferritic stainless steel according to the present disclosure has improved toughness and brittleness of a hot-rolled thick plate with a thickness of 6.0 mm or more, and can prevent winter season cracking.

The invention claimed is:

1. A ferritic stainless steel, the ferritic stainless steel comprising, in percent (%) by weight of the entire composition, C: more than 0 and 0.01% or less, Si: 0.8% or less, Mn: 0.5% or less, Cr: 10 to 14%, Ti: 0.01 to 0.45%, N: more than 0 and 0.015% or less, the remainder of iron (Fe) and other inevitable impurities, wherein the stainless steel has a microstructure that is a structure of an unrecrystallized recovery step, average of a kernel average misorientation value of the microstructure is 0.6 to 1.1, the stainless steel has a thickness of 6.0 to 25.0 mm, a yield strength of 305 MPa or more, a tensile strength of 430 MPa or more, an elongation of 36.5 to 40%, and satisfies equation (2)

$$20^\circ \text{ C. charpy impact energy} \times 40^\circ \text{ C. charpy impact energy} \geq 750 \text{ J/cm} \quad (2).$$

2. The ferritic stainless steel of claim 1, further comprising Ni: 0.3% or less, Cu: 0.5% or less, Al: 0.1% or less.

3. The ferritic stainless steel of claim 1, wherein the stainless steel satisfies a following equation (1)

$$Ti/(C+N) \geq 3 \quad (1)$$

wherein Ti, C, N represent content (% by weight) of each element.

4. The ferritic stainless steel of claim 1, consisting of, in percent (%) by weight of the entire composition, C: more than 0 and 0.01% or less, Si: 0.8% or less, Mn: 0.5% or less, Cr: 10 to 14%, Ti: 0.01 to 0.45%, N: more than 0 and 0.015% or less, Cu: 0.5% or less, Al: 0.1% or less, and the remainder of iron (Fe) and other inevitable impurities.

* * * * *